US006862752B2

(12) United States Patent
Ohba

(10) Patent No.: US 6,862,752 B2
(45) Date of Patent: Mar. 8, 2005

(54) TOILET SEAT COVER MECHANISM

(75) Inventor: Shunji Ohba, Shimada (JP)

(73) Assignee: Kabushiki Kaisha Ohba, Shimada (JP)

( * ) Notice: Subject to any disclaimer, the term of this patent is extended or adjusted under 35 U.S.C. 154(b) by 0 days.

(21) Appl. No.: 10/417,047

(22) Filed: Apr. 16, 2003

(65) Prior Publication Data

US 2004/0107485 A1 Jun. 10, 2004

(30) Foreign Application Priority Data

Apr. 17, 2002 (JP) ..... 2002-002171 U

(51) Int. Cl.[7] ..... A47K 13/14

(52) U.S. Cl. ..... 4/245.4; 4/245.3; 4/243.1; 4/244.1; 4/245.1; 4/245.8

(58) Field of Search ..... 4/245.4, 244.3, 4/243.1, 243.2, 243.3, 244.1, 244.2, 245.1, 245.3, 245.5, 245.6, 245.8, 245.9

(56) References Cited

U.S. PATENT DOCUMENTS 1,076,107 A * 10/1913 Edwards ..... 4/243.1
1,396,480 A * 11/1921 Vansickle ..... 4/244.1
1,429,724 A * 9/1922 Leon ..... 4/244.1
2,002,721 A * 5/1935 Harry ..... 4/244.1
2,752,611 A * 7/1956 Romeo ..... 4/244.1
4,264,992 A * 5/1981 Tromp ..... 4/244.1
5,590,424 A * 1/1997 Matsunaga et al. ..... 4/243.1
6,058,518 A * 5/2000 Akazawa ..... 4/245.4

FOREIGN PATENT DOCUMENTS

JP 3013477 5/1995
JP 3072648 8/2000

* cited by examiner

*Primary Examiner*—Gregory L. Huson
*Assistant Examiner*—Khoa D. Huynh
(74) *Attorney, Agent, or Firm*—Finnegan, Henderson, Farabow, Garrett & Dunner, L.L.P.

(57) ABSTRACT

In an inside of a cassette 11 which is stored integrally with a toilet seat lid 1, a plurality of toilet seat covers 12 are stored, and by opening and closing of the toilet seat lid 1 which stores the cassette 11, a part of the toilet seat cover 12 which is exposed from a lower lid 7 of the cassette 11 contacts an adhesive button 3 which is disposed on a toilet set 14 or a seat 2 of the toilet seat and adheres to this, and thereby, the toilet seat cover 12 is set on the toilet seat 14 or the seat 2 of the toilet seat. Also, in order to facilitate refilling of the toilet seat covers 12 into the inside of the cassette 11, disposed are fixing means and opening and closing means by which the toilet seat lid 1 and the cassette 11, and an upper lid 5 and the lower lid 7 of the cassette 11 can be easily detached and attached, or opened and closed.

6 Claims, 8 Drawing Sheets

TOILET SEAT COVER MECHANISM

TECHNICAL FIELD TO WHICH THE INVENTION BELONGS

This invention relates to a toilet seat cover mechanism by which a toilet seat cover is set on its upper part, each time when a toilet seat or a seat of the toilet seat is opened and closed, and it is utilized as a matter of course for a toilet which is newly manufactured, and it can be also utilized for an existing toilet by making it a multi-purpose type.

PRIOR ART

In order to increase cleanliness of a toilet and eliminate the uncomfortable feeling due to uses of other persons, on the occasion of satisfying a want of nature, to pull out a toilet seat cover from a container in which it is contained and to place it on a toilet seat, or, for an individual to place a cover paper etc. which he/she has on a toilet seat, there is the problem that it has to be set by a human hand each time and there are drawbacks such that the toilet seat cover on the toilet seat moves out of alignment or is damaged and so on.

Also, as an apparatus for loading a cover to a toilet seat, "TOILET SEAT COVER SHEET AUTOMATIC LOADING APPARATUS" which is shown in a gazette of Japanese Utility Model Registration No.3013477, "TOILET SEAT SHEET AND HOLDING STRUCTURE THEREOF AND UPPER LID FOR USE IN TOILET HAVING THE HOLDING STRUCTURE" which is shown in a gazette of Japanese Utility Model Registration No.3072648 and soon have been developed but, since, as to the former, there is a necessity to flip out a toilet cover sheet by use of a toilet cover sheet flipping machine, on the occasion of use, each time thereof and to magnetically attach a supply operation use magnet to a magnetic body which was mounted to a toilet main body, there were such problems that its operation is burdensome, and the cover sheet is damaged at the time of operation, and so on. Also, there was a problem that operationality on the occasion of refilling the toilet cover sheets is bad.

Furthermore, as to the latter, a toilet seat sheet is made to be of a structure that a plurality of sheets are layered, and a used surface is provided with a peeling part, and an opposed surface thereof is provided with an adhesive part so that the toilet seat cover is adhesively disposed on the toilet seat but, since there is a necessity to dispose the adhesive part and the peeling part to each sheet which is layered, there were such problems that its processing is burdensome, and the cost is high. Also, admitting that the peeling part is disposed, since it is of such a structure that each sheet is adhesively disposed, there were such problems that the sheet is not peeled off beautifully and is easy to be damaged and so on,

PROBLEMS THAT THE INVENTION IS TO SOLVE

This invention was developed on purpose to inexpensively provide a toilet seat cover mechanism in which, whenever a toilet seat cover is used, this is surely set on a toilet seat or a seat of a toilet seat, and in case that it came short, it can be easily refilled.

SUMMARY OF THE INVENTION

This invention proposes a toilet seat cover mechanism which has a cassette which is disposed between a toilet seat lid and a toilet seat or which is stored integrally with the toilet seat lid, a toilet seat cover which is stored in the inside of the cassette, and an adhesive button which is attached on the toilet seat for adhering the toilet seat cover, characterized in that the toilet seat lid or the cassette or both of them are provided with fixing means for detachably fixing both sides on its opposed surface, and the cassette is provided with opening and closing means which can open and close its upper lid and lower lid by one action, and a part of the lower lid is notched so that the toilet seat cover which is stored inside is adhered to the adhesive button and picked out.

The invention also proposes, in the invention as set forth above, the toilet seat cover mechanism in which low-friction processing is applied to the toilet seat cover at a contact surface with the adhesive button.

The invention also proposes, in the invention as set fort above, the toilet seat cover mechanism in which the fixing means is an engagement member such as a solenoid or a hook-shaped surface of Magic Tape (registered trademark) and so on which was disposed on any one of the toilet seat lid or the cassette, and an engagement receiving member such as a magnetic body or a ring-shaped surface of Magic Tape (registered trademark) and so on which was disposed on the other of the toilet seat lid or the cassette.

The invention also proposes, in the invention as set forth above, the toilet seat cover mechanism in which the opening and closing means is an engagement member which was disposed on any one of the upper lid or the lower lid of the cassette, and an engagement receiving member which was disposed on the other of the upper lid or the lower lid of the cassette.

The invention furthermore proposes, in the invention as set forth above, the toilet seat cover mechanism in which a seat of the toilet seat is disposed between the cassette and the toilet seat, and the adhesive button is provided on the toilet seat.

The invention additionally proposes, in the invention as set forth above, the toilet seat cover mechanism in which the cassette is provided with a pressing member in its inside for pressing this from an upper part of the toilet seat cover.

The invention achieves the purpose of providing a toilet seat cover mechanism that, each time of use, a toilet seat cover is surely set on a toilet seat or a seat of a toilet seat, and its refilling can be carried out by a simple operation, with minimum structural members and at low cost.

DETAILED DESCRIPTION OF THE DRAWINGS

Figure 1:
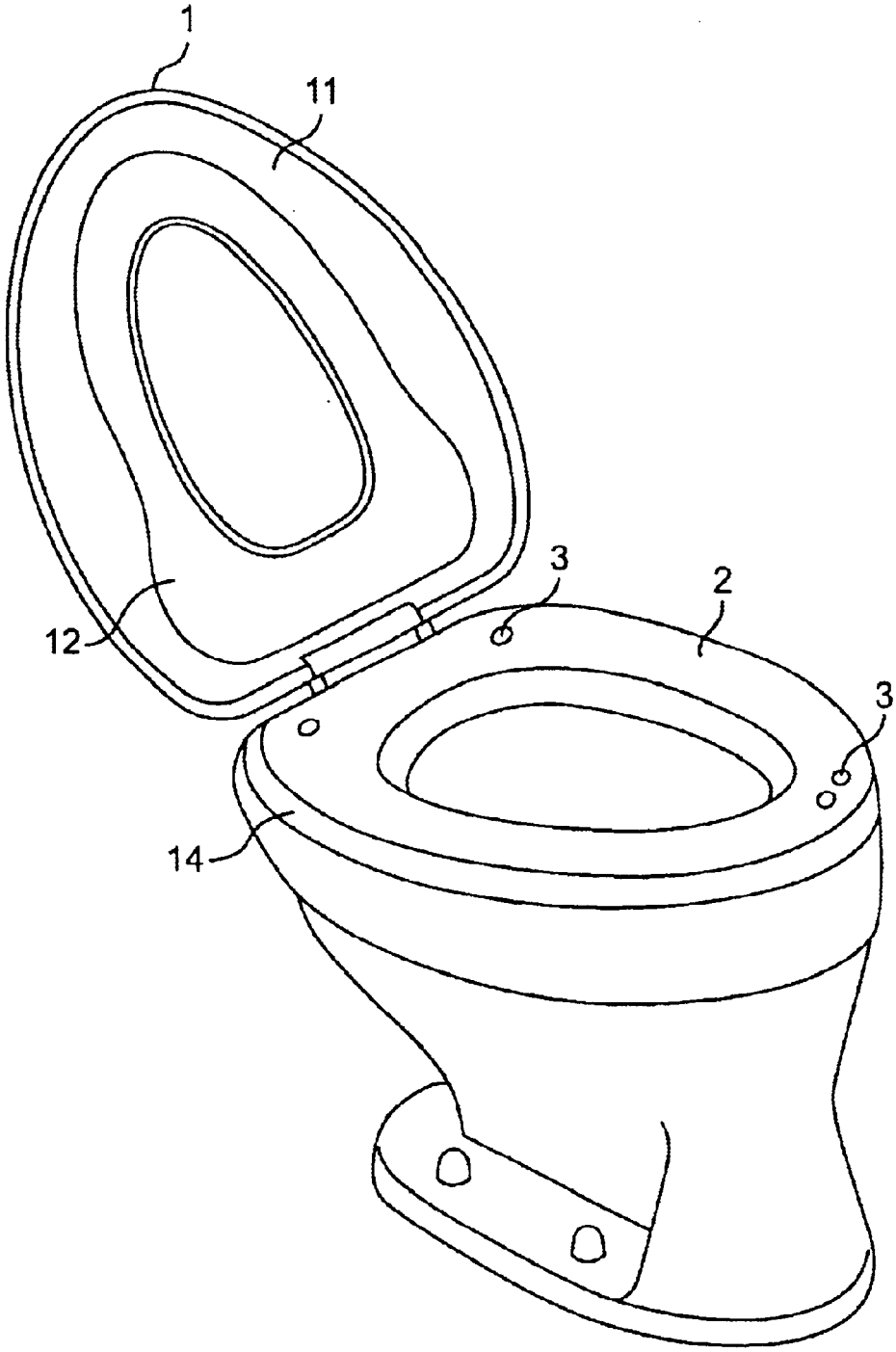
FIG. 1 is a schematic oblique perspective view showing an embodiment of a toilet having a toilet seat cover mechanism in the invention.
Figure 7:
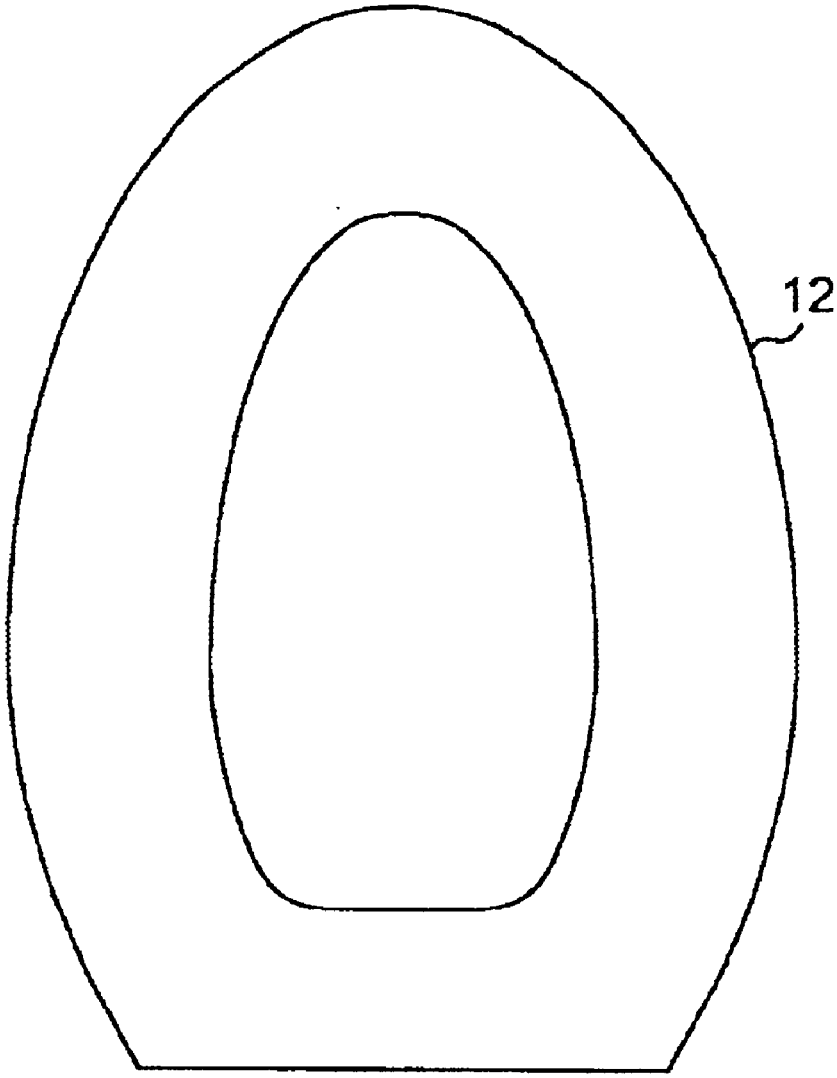
FIG. 7 is a schematic plan view of a toilet seat cover which is stored in a cassette inside.

FIG. 1 is one which shows one embodiment of the toilet seat cover mechanism in the invention, and one which relates to a multi-purpose type that can be also utilized for existing toilets. That is, in the multi-purpose type, in case that an adhesive button can not be attached on a toilet seat of the existing toilet, by loading the seat 2 of the toilet seat which had the adhesive buttons 3 between the cassette 11 and the toilet seat 14, it can be utilized without exchanging an entire toilet. On that account, in the figure, the adhesive buttons 3 is disposed on the seat 2 of the toilet seat but not on the toilet seat 14. The cassette 11 is, preferably, configured integrally so as to be stored in the toilet seat lid 1, and disposed between the toilet seat lid 1 and the toilet seat 14. A plurality of the toilet seat covers 12 are stored in the inside of the cassette 11. It is desirable that, in order to prevent an adhesive performance of the adhesive buttons 3 from bowering by paper fibers being attached even when the toilet seat cover 12 contacts the adhesive buttons 3 repeatedly, low-friction processing is applied to a contact surface with the adhesive buttons so as to reduce a friction coefficient. Also, in the embodiment shown in the figure, because of an O type toilet seat or a seat of a toilet seat, in order to be able to cover a whole thereof, as shown in FIG. 7, the toilet seat cover 12 is made to be of an O type shape.

The toilet seat lid 1 and the cassette 11 are attached in such a matter that, in a state that this was closed, they overlap closely on the toilet seat 14 or on the seat 2 of the toilet seat. There is no necessity that the cassette 11 is necessarily stored integrally with the toilet seat 1 but, in order for opening and closing to be carried out by opening and closing of the toilet seat 1 in synchronous with this, it is desirable that it is made as one-piece type as shown in the figure. Quality of a material of the cassette 11 is not specified in particular but it is desirable that it is made of light weight resin. Also, it is desirable that the adhesive buttons 3 are disposed on the toilet seat 14 or the seat 2 of the toilet seat at a plurality of points, and in the embodiment shown in FIG. 2, they are disposed at a front 1 point and rear 2 points so as for the toilet seat cover 12 to be able to be drawn out.

Figure 3:
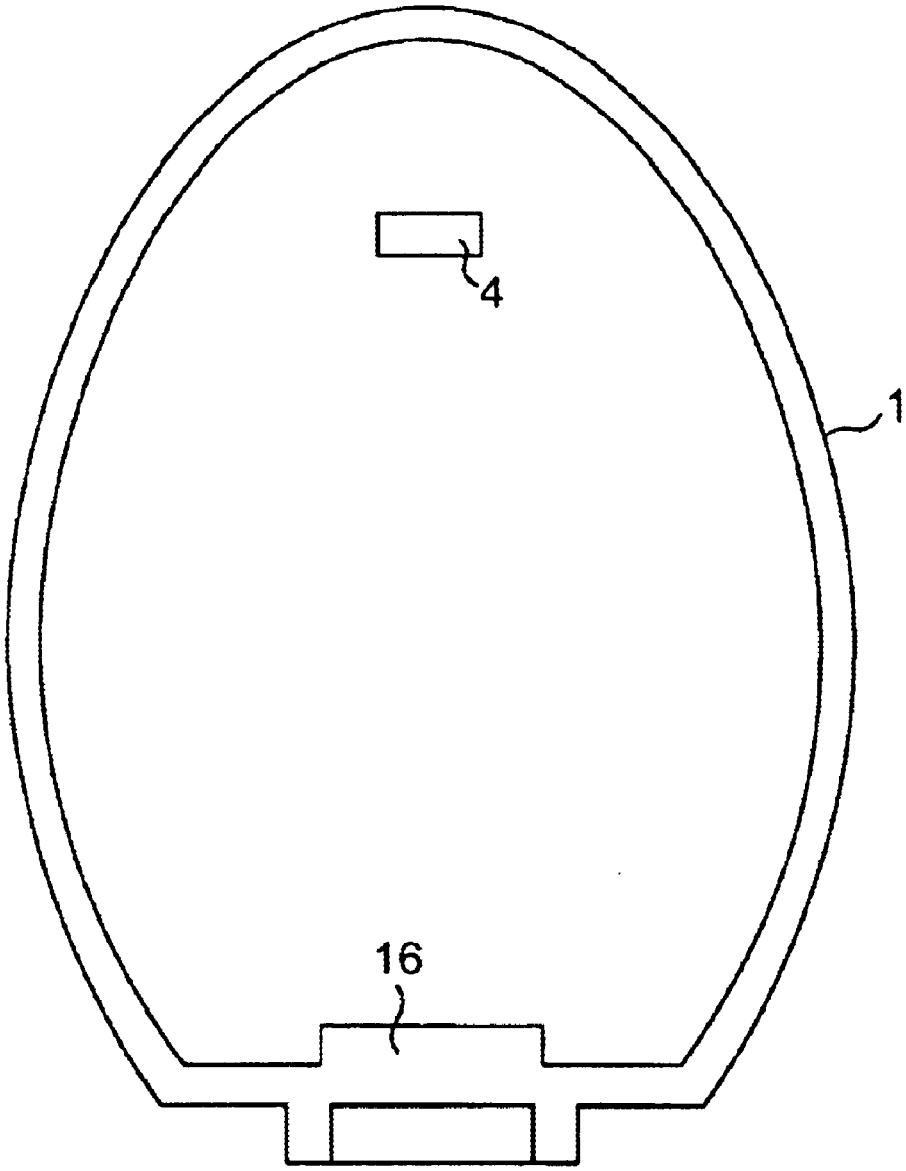
FIG. 3 is a schematic plan view showing a back surface of a toilet seat lid.
Figure 4:
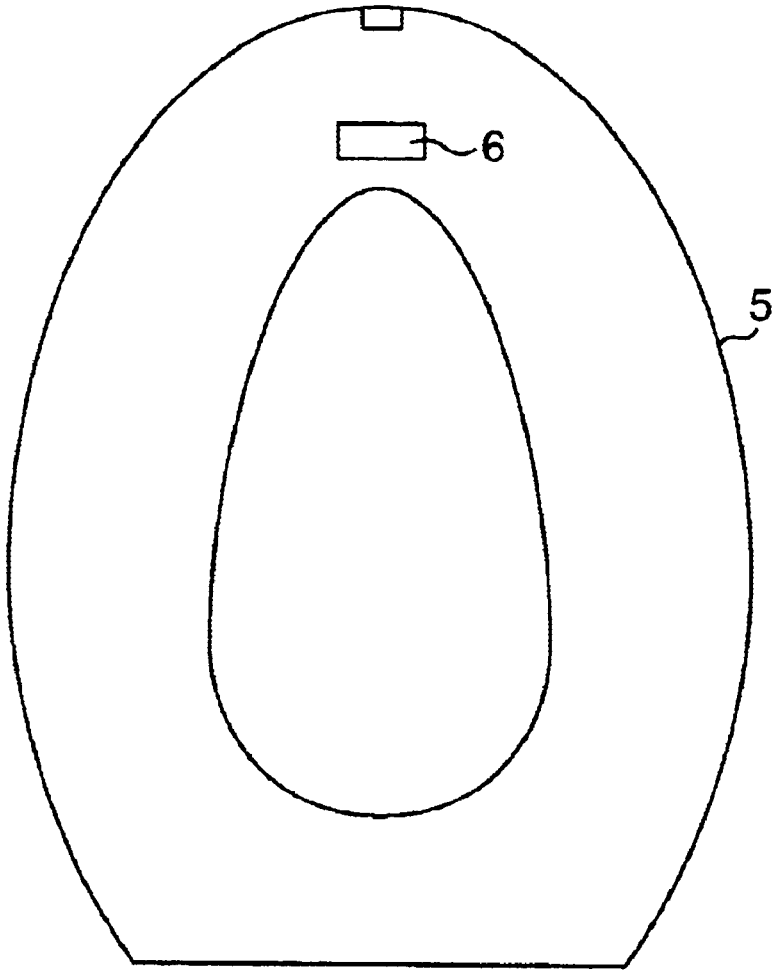
FIG. 4 is a schematic plan view showing a front surface of a cassette upper lid.

As shown in FIG. 1, in case that the cassette 11 was made as one-piece type to be stored in the toilet seat lid 1, it is important to simplify labor on the occasion of releasing storage of the cassette 11 from the toilet seat lid. That is, in case of toilets which were placed at a place with high frequency of use such as station yards, department stores and so on including public lavatories, there is necessity for persons in charge to carry out works for filling toilet seat covers within a short period of time, and to that end, there is a necessity for the above-described storage to be able to be easily released. In the invention, in order to solve such a problem, as shown in FIG. 3 and FIG. 4, the engagement member 4 such as a solenoid or a hook-shaped surface of Magic Tape (registered trademark) and so on is disposed on any one of the toilet seat 1 or an opposed surface of the cassette 11, and the engagement receiving member 6 such as a magnetic body or a ring-shaped surface of Magic Tape (registered trademark) and so on is disposed on the other thereof, which caused the storage to be easily released. By that, the above-described person in charge can easily pull apart the toilet seat 1 and the cassette 11, and can fill the toilet seat covers 12 in a short period of time. IN addition, in order for the storage of the cassette 11 to the toilet seat 1 to be able to be surely carried out, as shown in FIG. 3, it is desirable that the support part 16 for supporting a rear part of the cassette 11 is disposed.

Figure 5:
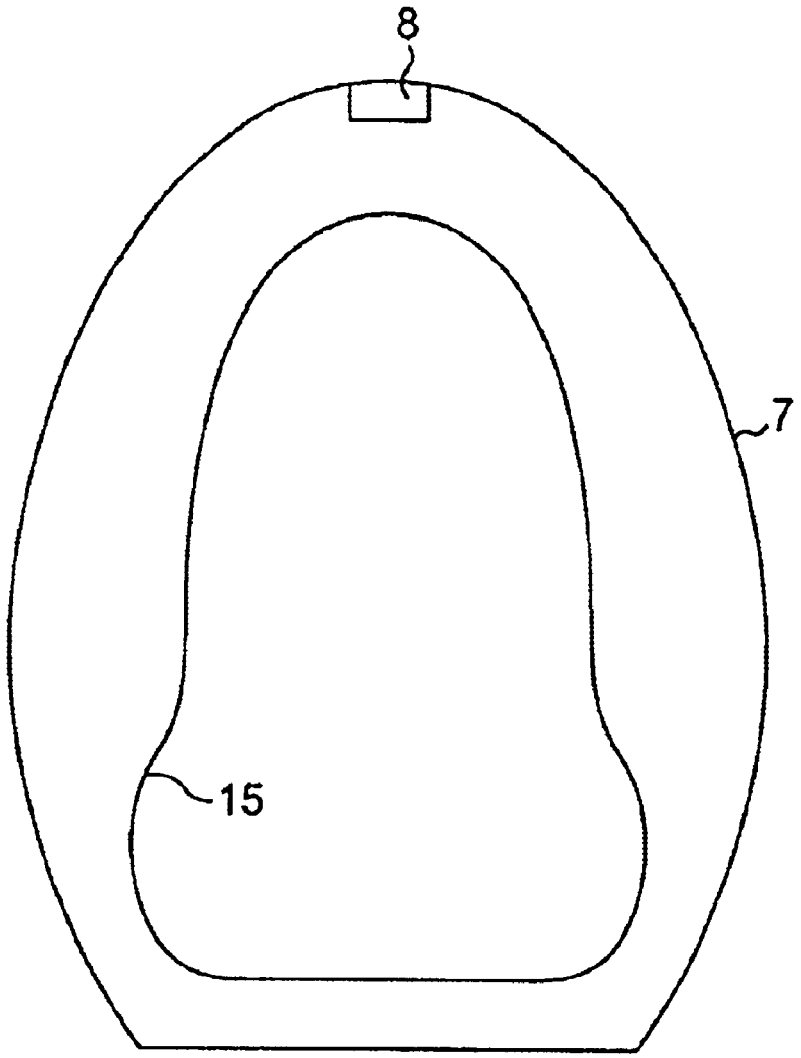
FIG. 5 is a schematic plan view showing a front surface of a cassette lower lid.

The cassette 11 is configured by the upper lid 5 shown in FIG. 4 and the lower lid 7 shown in FIG. 5, and in case that both sides were closed, has approximately the same outer shape dimension as the toilet seat 14 or the seat 2 of the toilet seat. In the case shown in the figure, it corresponds to O type toilet seats, and the shape of the entire cassette 11 combined with the upper lid 5 and the lower lid 7 is also made to be of O type so as to fit into it. In case of U type toilet seats, the cassette 11 also becomes a shape fitting into it, which is thought dare to require no explanation. However, in case of a seal-up type in which both of the upper lid 5 and the lower lid 7 are of the same shape, it becomes impossible to pull out the toilet seat cover 12 from the cassette 11 in a state that both sides were closed. Then, in order to solve this problem, in the invention, the upper lid 5 is, as shown in FIG. 4, of such a shape to cover up the entirety of the toilet seat cover 12, while the lower lid 7 is, as shown in FIG. 5, is made to be of such a shape that its inner ring 15 was notched, and thereby, a part of the toilet seat cover 12 is made to be exposed, and by that, the toilet seat cover 12 which contacted the adhesive buttons 3 was made to be pulled out due to its adhesion.

Figure 2:
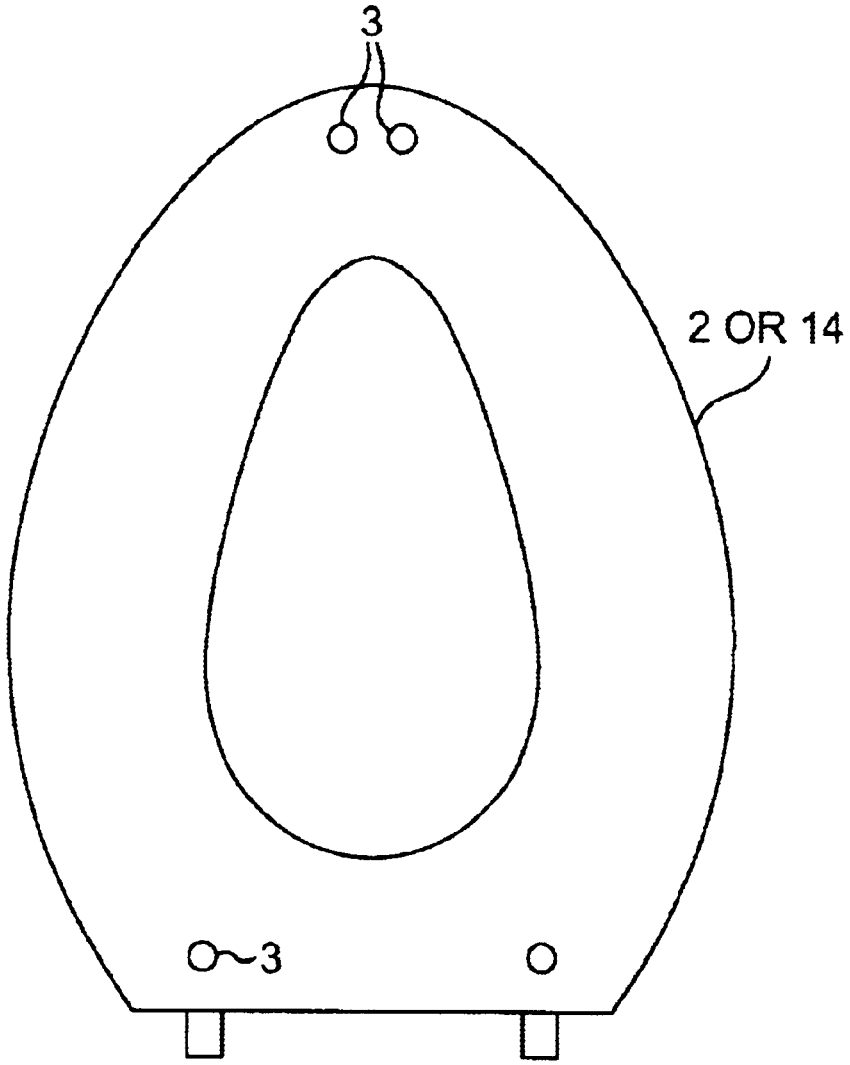
FIG. 2 is a schematic plan view showing a used surface of a toilet seat or a seat of a toilet seat.

Concretely, the inner ring 15 is notched in such a shape that, on the occasion that the cassette 11 which is stored integrally with the toilet seat 1 was closed to a side of the toilet seat 14 or the seat 2 of the toilet seat, the adhesive buttons 3 which is disposed on the toilet seat 14 or the seat 2 of the toilet seat contact a part of the toilet seat cover 12 in the cassette 11, and then, on the occasion that the toilet seat lid 1 was opened together with the cassette 11, the toilet seat cover 12 which was adhered by adhesive force of the adhesion buttons 3 is pulled out. On that account, a notch shape of the inner ring 15 differs depending upon an location at which the adhesive button 3 is disposed but, as a result of an experiment that the applicant carried out, most effective was adhesion at 3 points as shown in FIG. 2. Accordingly, in the figure, shown is the adhesion at 1 point of a front portion of the toilet seat 14 or the seat 2 of the toilet seat and at 2 points of a rear portion thereof. However, as to the location of the adhesive button 3, it is necessarily limited to this.

Figure 6:
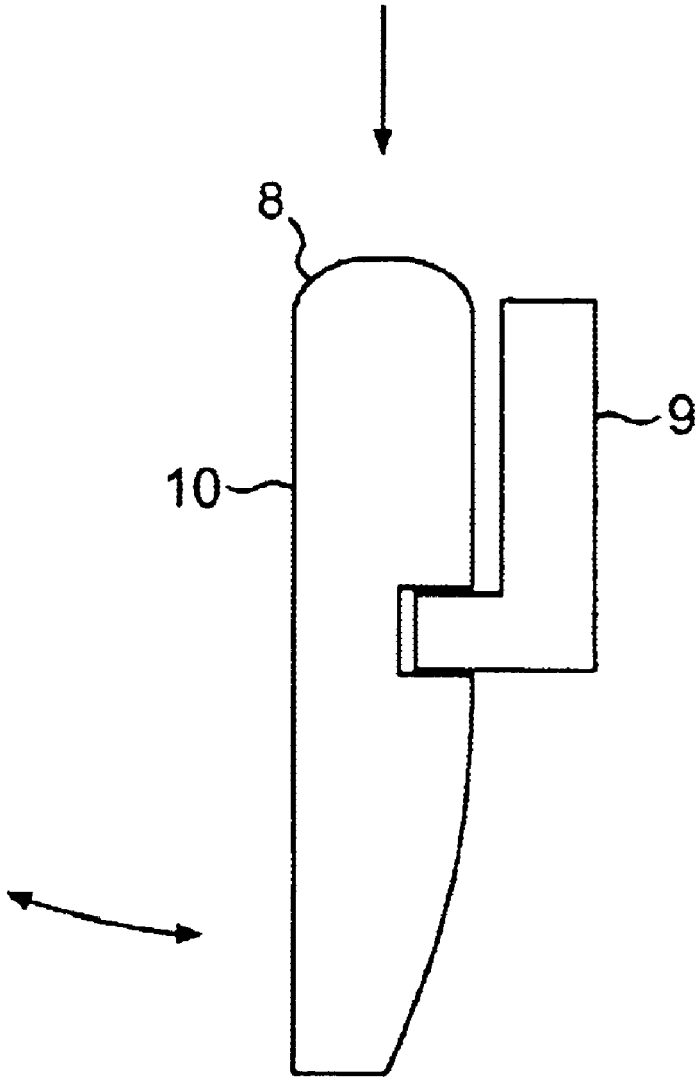
FIG. 6 is a schematic side view showing an opening and closing mechanism.

Also, as to the cassette 11, for the similar reason as described above, there is a necessity to simplify labor on the occasion of refilling the toilet seat covers 12 in the inside thereof. In the invention, in order to solve such a problem, adopted is an opening and closing mechanism by which opening and closing of the upper lid 5 and the lower lid 7 are easily carried out. Concretely, a latch member is disposed on any one of the upper lid 5 or the lower lid 7 of the cassette 11, and a latch receiving member is disposed on the other of the upper lid 5 or the lower lid 7 of the cassette 11, and thereby, they are made to be readily opened and closed by one action. In the embodiment shown in FIG. 6, the latch member 9 having a L letter shaped protrusion is disposed on any one of the upper lid 5 or the lower lid 7, and also, the latch receiving member 10 having a depressed portion which is engaged with the protrusion of the latch member is disposed on the other of the upper lid 5 or the lower lid 7, respectively, and as shown in FIG. 5, it is configured that, by pushing the opening and closing button 8 which is equivalent to a top of the latch receiving member 10, engagement of the latch member 9 and the latch receiving member 10 is released and the upper lid 5 and the lower lid 7 are readily opened.

Figure 8:
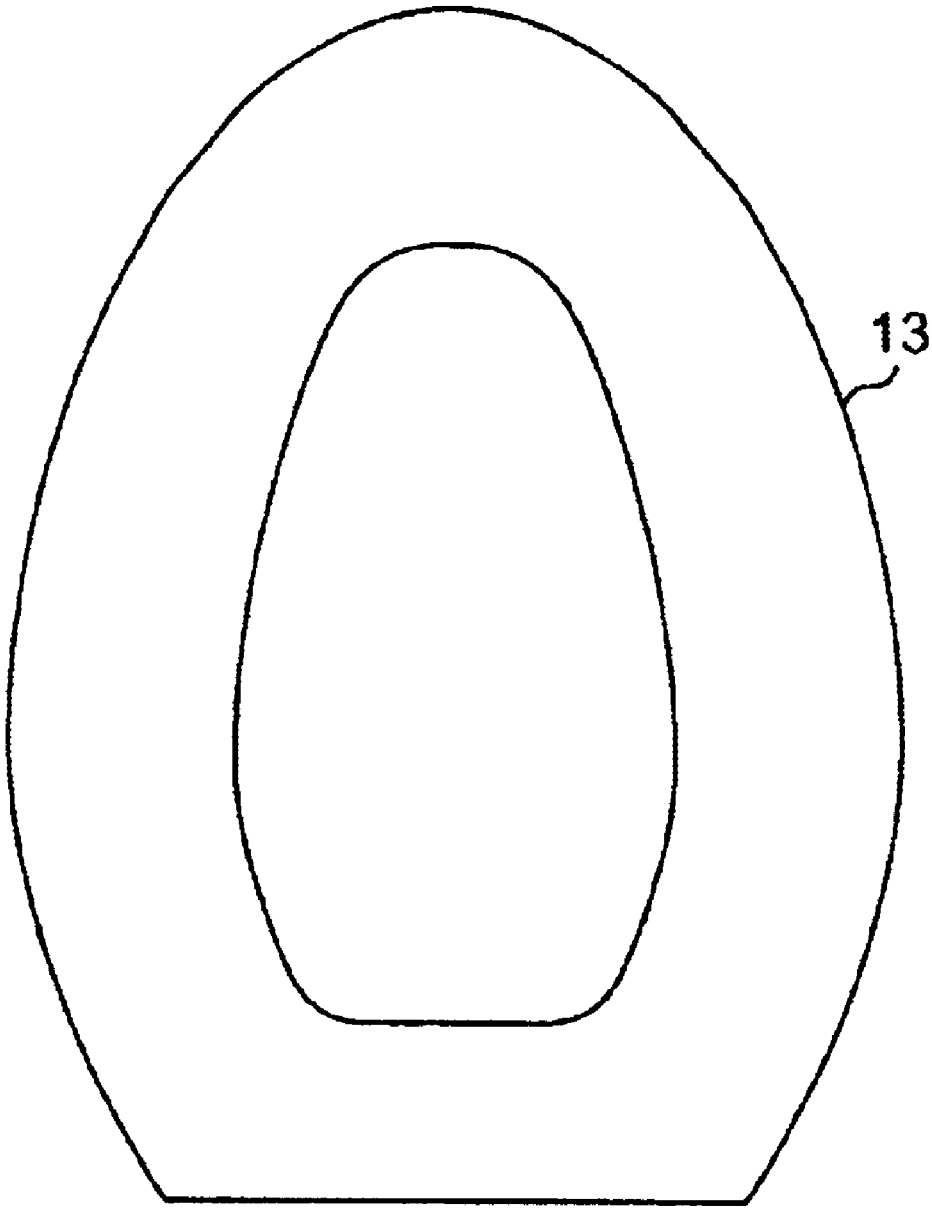
FIG. 8 is a schematic plan view of a pressing member which is set on an upper part of the toilet seat cover. 1 designates a toilet seat lid, 2 designates a seat of a toilet seat, 3 designates an adhesive button, 4 designates an engagement member, 5 designates an upper lid of a cassette, 6 designates an engagement receiving member, 7 designates a lower lid of the cassette, 8 designates an opening and closing button, 9 designates a latch member, 10 designates a latch receiving member, 11 designates the cassette, 12 designates a toilet seat cover, 13 designates a pressing member, 14 designates a toilet seat, 15 designates an inner ring of the cassette lower lid, and 16 designates a support part.

In addition, in a desirable embodiment of the invention, in order to facilitate the pulling-out of the toilet seat cover 12 by the adhesion of the adhesive button 3, it is desirable that a pressing member for pressing the toilet seat cover 12 from the upper part thereof is disposed in the inside of the cassette 11. In the embodiment shown in FIG. 8, the pressing member 13 is made to be a flat plate of approximately the same shape as the toilet seat cover 12, and by being mounted on a most top part of the toilet seat cover 12 in the cassette 11, the toilet seat cover 12 is pressed from the upper part and the pulling-out of the toilet seat cover 12 by the adhesive button 3 is facilitated. As to the pressing member 13, in addition to one shown in the figure, it may be configured that for example, biasing means such as a hand-grip with a spring on is disposed on an inner wall of the upper lid 5 of the cassette 11, and by its biasing force, the toilet seat cover 12 is pressed down from the upper part.

Thus, as a result that the toilet seat cover mechanism relating to the invention is configured as described above, the cassette 11 is opened and closed in synchronous with the toilet seat lid 1, and it is possible to easily release the storage thereof. Furthermore, since it is possible to leave the upper lid 5 and the lower lid 7 open by one action, it is possible to carry out the refilling of the toilet seat covers 12 to the inside swiftly. Also, since a part of the toilet seat cover 12 is made to be exposed by notching the inner ring 15 of the lower lid 7 of the cassette 11, the pulling-out of the toilet seat cover 12 by the adhesion of the adhesive buttons 3 on the toilet seat 14 or the seat 2 of the toilet seat was realized. On that account, on the occasion that a previous user satisfied a want of nature and closed the toilet seat 1 together with the cassette 11, since the adhesive buttons 3 which are disposed on the toilet seat 14 or the seat 2 of the toilet seat contact and adhere to a part of the toilet seat cover 12, on the occasion that a next user satisfies a want of nature, by simply opening the toilet seat 1, the toilet seat cover 12 adhered to the adhesive buttons 3 is pulled out from the inside of the cassette 11, and is to be set on the toilet seat 14 or the seat 2 of the toilet seat which has the adhesive buttons 3. Hereinafter, in the toilet having the toilet seat cover mechanism relating to the invention, procedures until the toilet seat cover is set will be briefly described.

Firstly, a previous user sits on the toilet seat cover 12 which was set on the toilet seat 14 or the seat 2 of the toilet seat and satisfies a want of nature. After bowel movement is completed, the toilet seat cover 12 which was used is detached from the adhesive buttons 3, and after water washing is carried out together with human waste, the toilet seat lid 1 is closed. Then, the cassette 11 which is stored integrally with the toilet seat lid 1 is also closed.

Since the cassette 11 is closed together with the toilet seat lid 1, a part of the toilet seat cover 12 which was exposed from the notched part formed in the inner ring 15 of the lower lid 7 thereof contacts the adhesive buttons 3 which were disposed on the toilet seat 14 or the seat 2 of the toilet seat, and by adhesion force of the adhesive button 3, its contact portion is adhered.

A new user enters a rest room to satisfy a want of nature, and opens the toilet seat lid 1. Then, since the cassette 11 which is integral with the toilet seat lid 1 is also opened, the toilet seat cover 12 is, by the adhesion of the adhesive buttons 3, gradually pulled out from the notched part formed in the inner ring 15 of the lower lid 7, and in a state that the toilet seat lid 1 is fully opened together with the cassette 11, the toilet seat cover 12 adhered to the adhesive buttons 3 remains on the toilet seat 14 or the seat 2 of the toilet seat, and is set so as to be able to be used.

There, the new user sits on the toilet seat cover 12 which was set and satisfies a want of nature, and when bowel movement is completed, water washing is carried out and the toilet 1 is again closed, and thereby, on the occasion that a succeeding user opens the toilet seat lid 1, a new toilet seat cover 12 is again set on the toilet seat 14 or the seat 2 of the toilet seat. By this means, in the toilet seat cover mechanism according to the invention, since, by simply opening and closing the cassette 11 or the toilet seat lid 1 which integrally stores the cassette 11, the new toilet seat cover 12 is always set on the toilet seat 14 or the seat 2 of the toilet seat, it is possible to satisfy a want of nature in a sanitary condition. In addition, in case that a previous user did not close the toilet seat lid 1 after bowel movement, a new user simply opens and closes the toilet seat lid 1 one time on the occasion of use, and thereby, a new toilet seat cover 12 can be set, which is needless to say.

[Advantage of the Invention]

As described above, in the toilet seat cover mechanism of the invention, since it is possible to set the toilet seat cover which is stored in the cassette on the toilet seat or the seat of the toilet seat by simply opening and closing the cassette or the toilet seat lid which integrally stores this, it is possible to satisfy a want of nature always in a sanitary condition. Also, in addition to that it is possible to readily detach and attach the cassette and the toilet seat lid, since it is possible to open and close the upper lid and the lower lid of the cassette by one action, it is possible to carry out the refilling of the toilet seat covers to the inside in a short period of time. Furthermore, by disposing the seat of the toilet seat having the adhesive buttons between the cassette and the toilet seat, even a known toilet in which the adhesive buttons can not be disposed on the toilet seat can be utilized in a multi-purpose manner. In addition, by disposing the pressing member for pressing the toilet seat cover to the inside of the cassette, it is possible to facilitate the pulling-out of the toilet seat cover. Also, since, by applying low friction processing to the contact surface with the adhesive buttons of the toilet seat cover, it is possible to decrease adhesion of paper fibers to the adhesive buttons, there occurs decrease of adhesion performance even by repeated uses.

What is claimed is:

1. A toilet seat cover mechanism comprising a toilet seat, a toilet seat lid and a cassette disposed between the toilet seat lid and the toilet seat, a toilet seat cover stored in the inside of the cassette, and at least one adhesive button secured to the toilet seat for adhering the toilet seat cover to the toilet seat, wherein the toilet seat lid or the cassette or both are provided with fixing means for detachably fixing the cassette to the lid, the cassette has an upper lid and a lower lid and is provided with an opening and closing means which can open and close the upper lid and lower lid with respect to each other, and a part of the lower lid of the cassette is notched so that a part of the toilet seat cover which is stored in the inside of the cassette will adhere to the adhesive button and be picked out of the cassette when the toilet seat lid is closed.

2. The toilet seat cover mechanism as set forth in claim 1, wherein low-friction processing is applied to the toilet seat cover where it contacts the adhesive button.

3. The toilet seat cover mechanism as set forth in claim 1, wherein the fixing means comprises an engagement member disposed on the toilet seat lid or the cassette, and an engagement receiving member disposed on the other of the toilet seat lid or the cassette.

4. The toilet seat cover mechanism as set forth in claim 1, wherein the opening and closing means comprises a latch member disposed on the upper lid or the lower lid of the cassette, and a latch receiving member disposed on the other of the upper lid or the lower lid of the cassette.

5. The toilet seat cover mechanism as set forth in claim 1, wherein a seat of the toilet seat is disposed between the cassette and the toilet seat, and the adhesive button is provided on the seat of the toilet seat.

6. The toilet seat cover mechanism as set forth in any one of claims 1 to 4, wherein the cassette includes a pressing member in its inside for pressing down on an upper part of the toilet seat cover.

* * * * *